US010128585B1

(12) United States Patent
Xu et al.

(10) Patent No.: US 10,128,585 B1
(45) Date of Patent: Nov. 13, 2018

(54) AUDIO JACK CONNECTOR

(71) Applicant: Cheng Uei Precision Industry Co., Ltd., New Taipei (TW)

(72) Inventors: Xiao-Dong Xu, Dong-Guan (CN); Ji-Ping Zhong, Dong-Guan (CN); Qing-Hong Lin, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/721,657

(22) Filed: Sep. 29, 2017

(51) Int. Cl.

| | |
|---|---|
| ***H01R 24/00*** | (2011.01) |
| ***H01R 9/05*** | (2006.01) |
| ***H01R 13/622*** | (2006.01) |
| ***H01R 13/703*** | (2006.01) |
| ***H01R 24/58*** | (2011.01) |
| *H01R 103/00* | (2006.01) |

(52) U.S. Cl.
CPC ..... *H01R 9/05* (2013.01); *H01R 13/622* (2013.01); *H01R 13/7033* (2013.01); *H01R 24/58* (2013.01); *H01R 2103/00* (2013.01)

(58) Field of Classification Search
CPC ..... H01R 24/58; H01R 13/70; H01R 33/94; H01R 33/92; H01R 33/9555
USPC ..... 439/668, 669; 200/51 R, 51.03–51.06
See application file for complete search history.

(56) References Cited

U.S. PATENT DOCUMENTS

| | | | | |
|---|---|---|---|---|
| 4,426,558 | A * | 1/1984 | Tanaka | H01R 24/58 200/51.09 |
| 4,725,239 | A * | 2/1988 | Shichida | H01R 39/64 439/29 |
| 5,569,053 | A * | 10/1996 | Nelson | B60N 3/14 439/638 |
| 6,471,546 | B1 * | 10/2002 | Zhu | H01R 12/707 439/607.4 |
| 6,595,804 | B2 * | 7/2003 | Nagata | H01R 24/58 439/668 |
| 6,835,080 | B1 * | 12/2004 | Chang | H01R 13/7031 439/188 |
| 6,918,799 | B2 * | 7/2005 | Zhu | H01R 24/58 439/668 |
| 7,044,804 | B2 * | 5/2006 | Han | G02B 6/4277 385/75 |
| 7,108,529 | B1 * | 9/2006 | Huang | H01R 13/703 200/51.1 |

(Continued)

*Primary Examiner* — Thanh Tam Le
(74) *Attorney, Agent, or Firm* — Cheng-Ju Chiang

(57) ABSTRACT

An audio jack connector includes an insulating housing, a plurality of conductive terminals fastened to the insulating housing, and a switch terminal assembly mounted to the insulating housing. The switch terminal assembly includes a first switch terminal having an elastic arm, and a second switch terminal. A tail end of the elastic arm is connected with a first touch portion. A connecting portion connected between the tail end of the elastic arm and the first touch portion is fastened with an insulating block. The second switch terminal has a second touch portion. An audio plug connector is inserted into the audio jack connector. After contact portions of the plurality of the conductive terminals contact corresponding docking positions of the audio plug connector, the audio plug connector pushes against the insulating block to move downward to make the first touch portion abut against the second touch portion.

16 Claims, 6 Drawing Sheets

(56) References Cited

U.S. PATENT DOCUMENTS

| | | | | |
|---|---|---|---|---|
| 7,198,504 | B2 * | 4/2007 | Chien | G02B 6/4201 439/385 |
| 7,294,022 | B1 * | 11/2007 | Cheng | H01R 13/70 200/530 |
| 7,618,294 | B1 * | 11/2009 | Lin | H01R 13/701 200/51 R |
| 7,785,119 | B1 * | 8/2010 | Chiang | H01R 13/7036 439/188 |
| 7,963,784 | B1 * | 6/2011 | Su | H01R 13/703 439/188 |
| 7,963,807 | B1 * | 6/2011 | Yang | H01R 24/58 439/668 |
| 8,070,528 | B2 * | 12/2011 | Wang | H01R 24/58 439/668 |
| 8,864,530 | B2 * | 10/2014 | Uno | H01R 13/7032 439/668 |
| 8,951,071 | B2 * | 2/2015 | Tziviskos | H01R 13/15 439/668 |

* cited by examiner

AUDIO JACK CONNECTOR

BACKGROUND OF THE INVENTION

1. Field of the Invention

The present invention generally relates to a connector, and more particularly to an audio jack connector.

2. The Related Art

As is known to all, an audio jack connector is an electronic element for transmitting audio signals, after an audio plug connector of an earphone or a loudspeaker is inserted into an audio jack connector, a music sound and a broadcast sound can be heard by the earphone or the loudspeaker.

A conventional audio jack connector includes an insulating housing, a plurality of conductive terminals and a switch terminal assembly. After the audio plug connector is inserted into the audio jack connector, the plurality of the conductive terminals contact corresponding docking positions of the audio plug connector for transmitting different audio signals. The switch terminal assembly includes a first switch terminal and a second switch terminal. When the audio plug connector is inserted into the audio jack connector, the audio plug connector pushes against the first switch terminal to contact the second switch terminal, so that an electrical conduction is formed between the audio plug connector and the audio jack connector.

However, after the electrical conduction is formed between the audio plug connector and the audio jack connector, namely the audio plug connector pushes against the first switch terminal to contact the second switch terminal, some of the plurality of the conductive terminals are still without achieving the corresponding docking positions of the audio plug connector, so that noises of the earphone or the loudspeaker are caused in the process of the audio plug connector being inserted into the audio jack connector.

SUMMARY OF THE INVENTION

An object of the present invention is to provide an audio jack connector adapted for being docked with an audio plug connector. The audio jack connector includes an insulating housing, a plurality of conductive terminals and a switch terminal assembly. An inside of the insulating housing opens an insertion hole penetrating through a front surface of the insulating housing. The audio plug connector is capable of being inserted into the insertion hole. A rear end of the insulating housing opens an opening communicated between the insertion hole and an outside of the insulating housing. The plurality of conductive terminals are fastened to the insulating housing. Each of the plurality of the conductive terminals has a contact portion. The contact portions of the plurality of the conductive terminals elastically project into the insertion hole and are capable of abutting against corresponding docking positions of the audio plug connector. The contact portions of the plurality of the conductive terminals are substantially located in front of the opening. The switch terminal assembly is mounted to the insulating housing. The switch terminal assembly includes a first switch terminal and a second switch terminal which abut against or break away from each other. The first switch terminal has a first fixing portion fastened to the insulating housing, and an elastic arm connected with the first fixing portion. A tail end of the elastic arm is connected with a first touch portion extending sideward. The tail end of the elastic arm is located under the opening. A connecting portion connected between the tail end of the elastic arm and the first touch portion is fastened with an insulating block. The insulating block is inserted into the insertion hole from the opening. The insulating block has an inclined surface capable of docking with the audio plug connector. The inclined surface is inclined rearward and upward. The second switch terminal is fastened to the insulating housing. The second switch terminal has a second fixing portion, and a second touch portion extended frontward from a front edge of the second fixing portion. The second touch portion is located under and spaced from the first touch portion. The audio plug connector is inserted into the audio jack connector from the insertion hole. After the contact portions of the plurality of the conductive terminals contact the corresponding docking positions of the audio plug connector, the audio plug connector pushes against the insulating block to move downward to make the first touch portion abut against the second touch portion.

Another object of the present invention is to provide an audio jack connector. The audio jack connector includes an insulating housing, a plurality of conductive terminals and a shell. The insulating housing is of a substantially hollow cylinder shape and opens an insertion hole penetrating through a front surface of the insulating housing. The plurality of conductive terminals are fastened to the insulating housing. Each of the plurality of the conductive terminals has a contact portion and a soldering portion. The contact portions of the plurality of the conductive terminals are positioned longitudinally along the insulating housing and in sequence. The shell is of a hollow cylinder shape and surrounds a peripheral surface of the insulating housing. A rear surface and the front surface of the insulating housing are exposed outside. The soldering portions of the conductive terminals are extended beyond the shell from the rear surface of the insulating housing.

Another object of the present invention is to provide an audio jack connector. The audio jack connector includes a main portion, a front cover, a rear cover fastened to a rear end of the main portion, a plurality of conductive terminals, a first switch terminal and a second switch terminal. The front cover is mounted to a front end of the main portion. The front cover opens an insertion hole penetrating through a front surface of the front cover and extending in the main portion. The plurality of conductive terminals are fastened to the main portion. Each of the conductive terminals has a contact portion elastically projecting into the insertion hole, and a soldering portion located on a surface of the rear cover. The first switch terminal has an elastic arm projecting into the insertion hole, and a first soldering foot located on the surface of the rear cover. The second switch terminal abuts against or breaks away from the first switch terminal. The second switch terminal has a second soldering foot located on the surface of the rear cover.

As described above, after the contact portions of the plurality of the conductive terminals contact the corresponding docking positions of the audio plug connector, the audio plug connector pushes against the insulating block to move downward to make the first touch portion of the first switch terminal abut against the second touch portion of the second switch terminal, so an electrical conduction is made between the audio jack connector and the audio plug connector. As a result, noises of the earphone or the loudspeaker are without being caused in the process of the audio plug connector being inserted into the audio jack connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
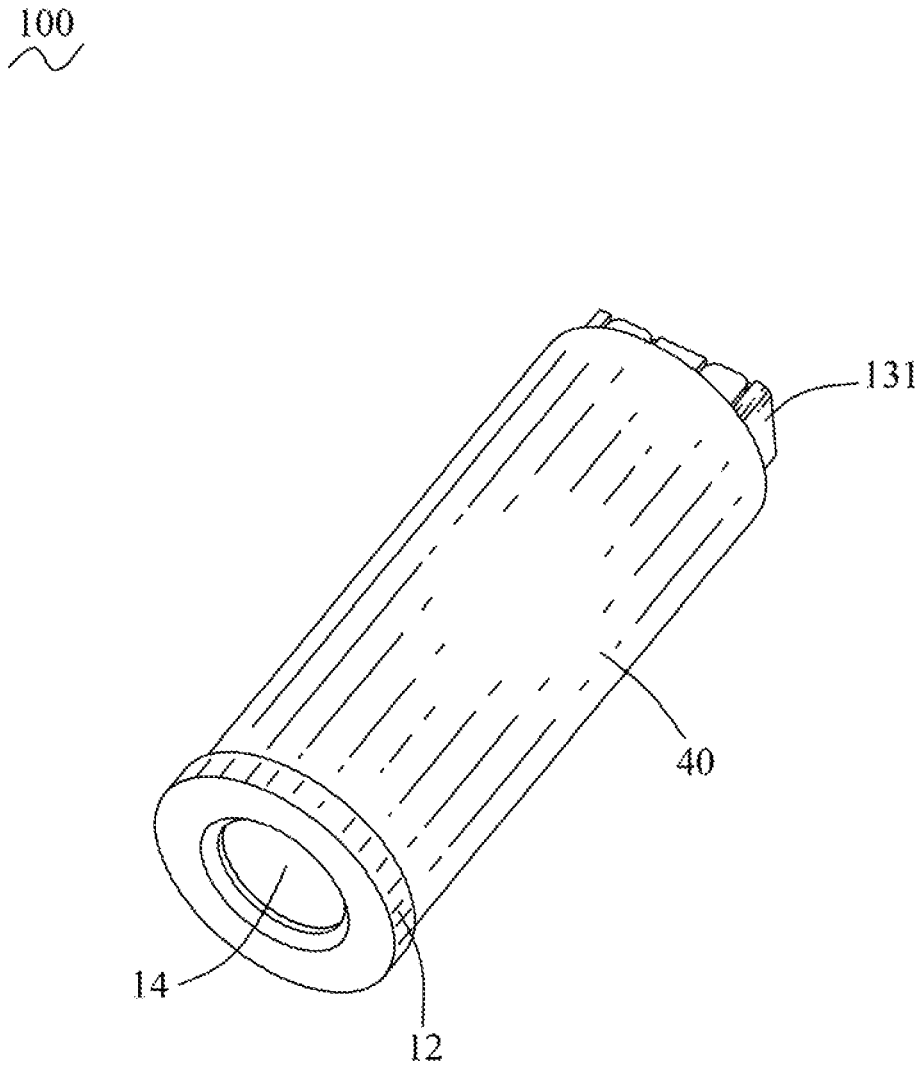
FIG. 1 is a perspective view of an audio jack connector in accordance with the present invention.

With reference to FIG. 1, FIG. 2, FIG. 4 and FIG. 6, an audio jack connector 100 in accordance with the present invention is shown. The audio jack connector 100 adapted for being docked with an audio plug connector 200 of an earphone (not shown) or a loudspeaker (not shown), includes an insulating housing 10, a plurality of conductive terminals 20, a switch terminal assembly 30 and a shell 40.

Figure 2:
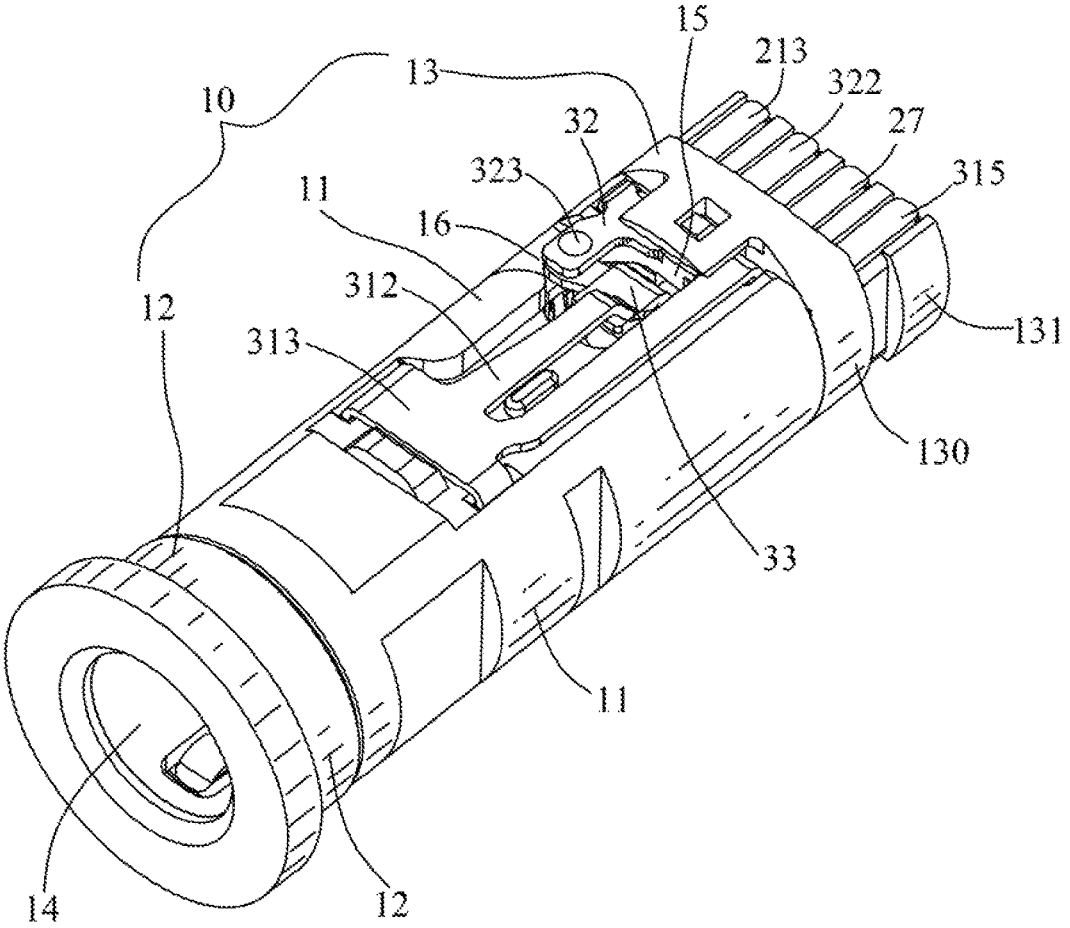
FIG. 2 is a partially perspective view of the audio jack connector of FIG. 1, wherein a shell is omitted.
Figure 3:
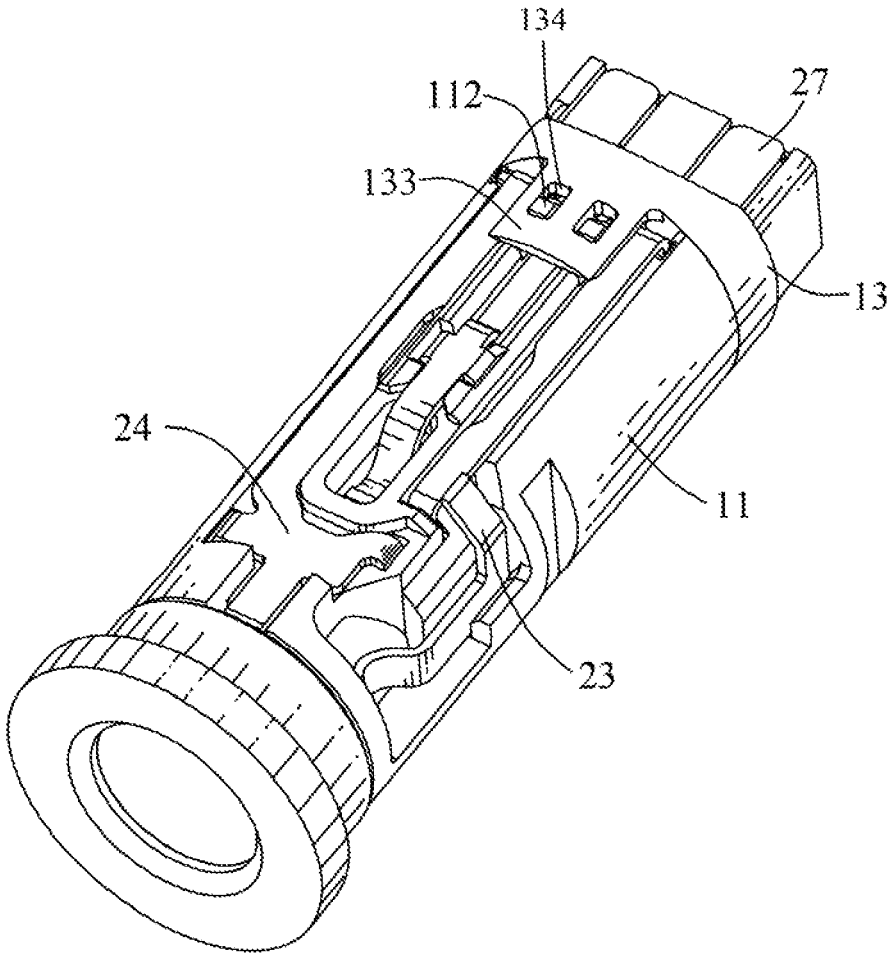
FIG. 3 is another partially perspective view of the audio jack connector of FIG. 1, wherein the shell is omitted.
Figure 4:
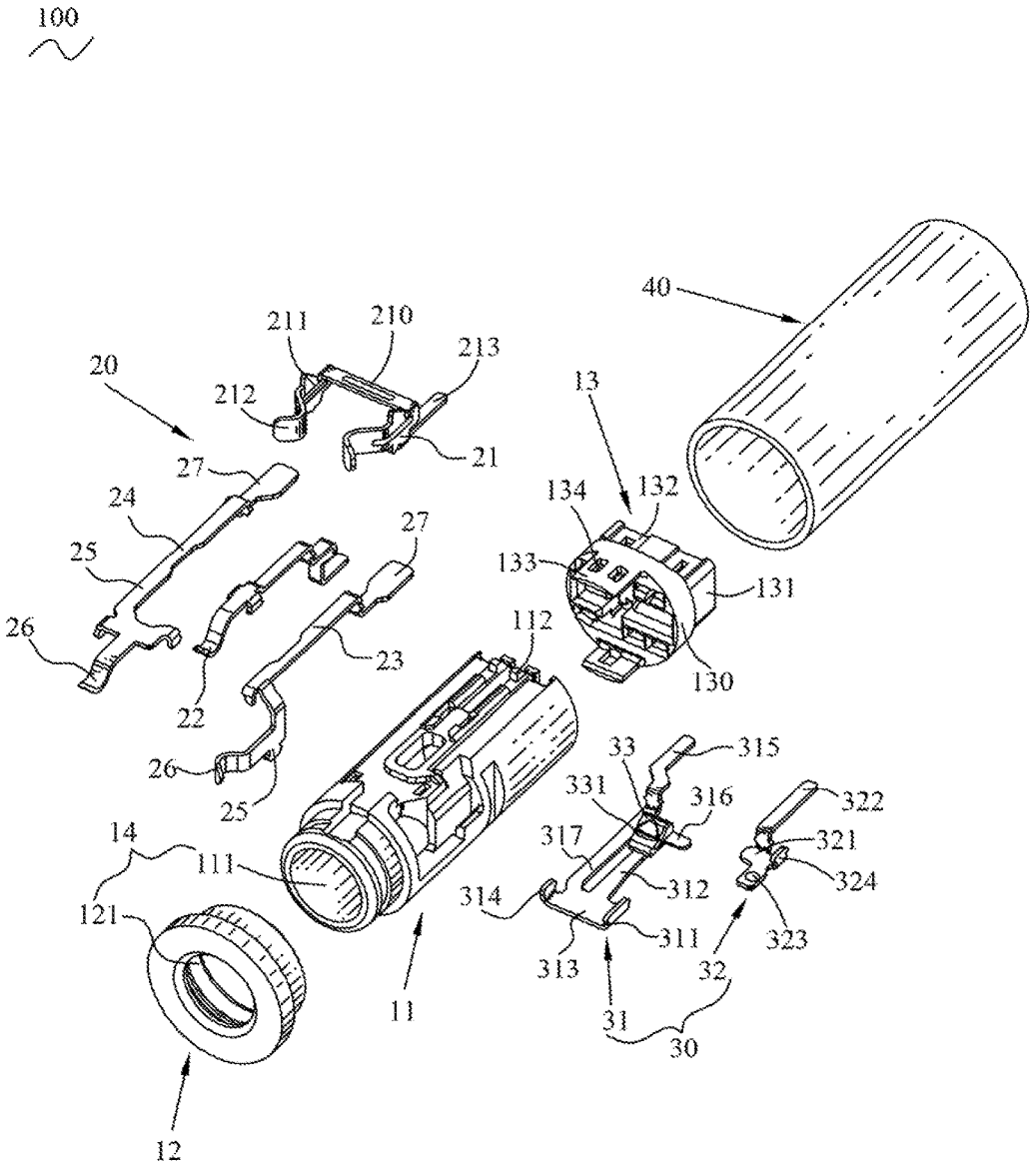
FIG. 4 is an exploded perspective view of the audio jack connector of FIG. 1.
Figure 5:
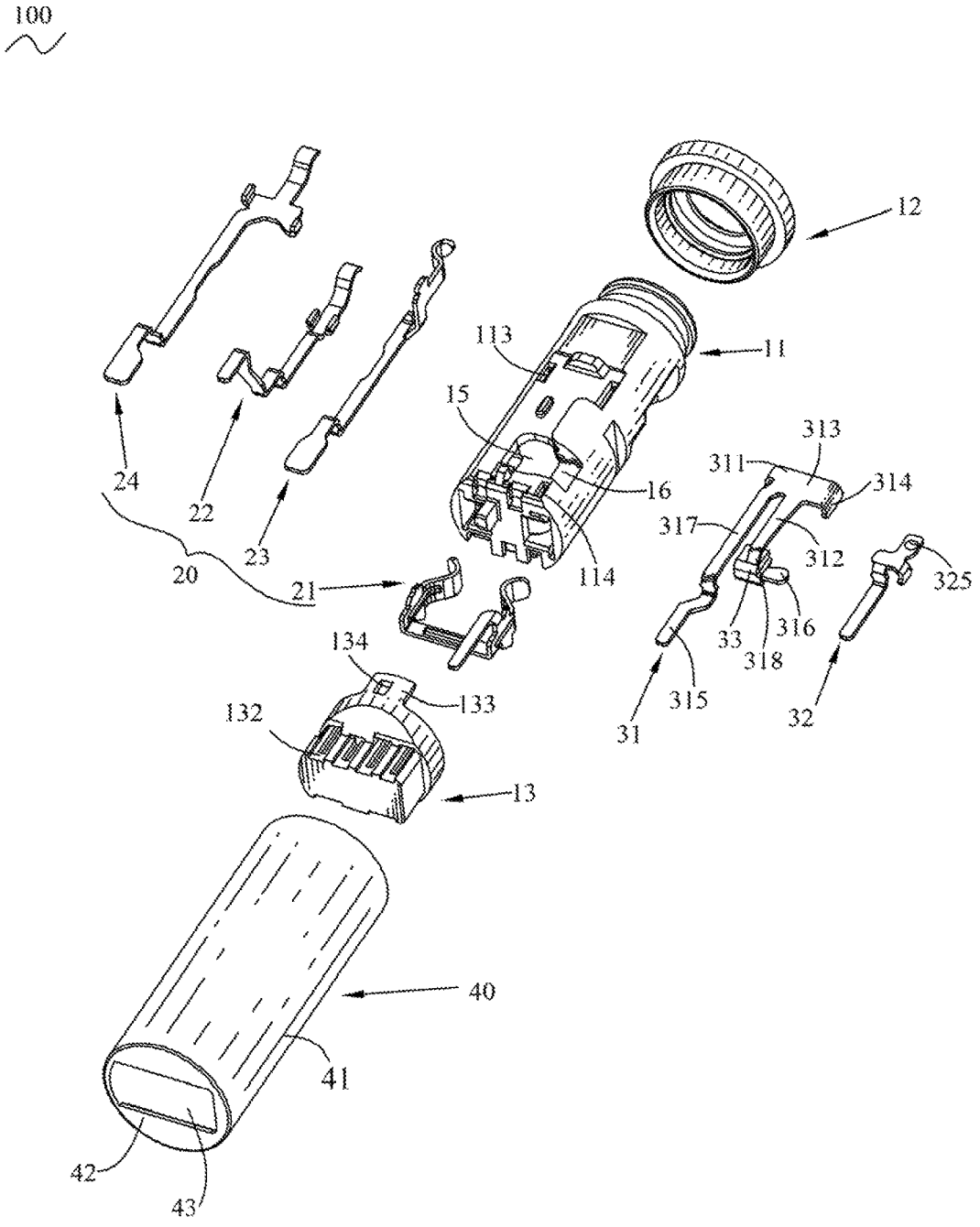
FIG. 5 is another exploded perspective view of the audio jack connector of FIG. 1.

Referring to FIG. 2, FIG. 4 and FIG. 5, the insulating housing 10 is of a substantially hollow cylinder shape. The insulating housing 10 includes a main portion 11, a front cover 12, and a rear cover 13. An inside of the insulating housing 10 opens an insertion hole 14 penetrating through a front surface of the insulating housing 10. The audio plug connector 200 is capable of being inserted into the insertion hole 14. A rear end of the insulating housing 10 opens an opening 15 communicated between the insertion hole 14 and an outside of the insulating housing 10. The rear end of the insulating housing 10 opens a notch 16 recessed inward towards the inside of the insulating housing 10, and communicated with the opening 15 and the insertion hole 14. An inside of the main portion 11 opens a first insertion hole 111 penetrating through a front surface of the main portion 11. Two sides of a bottom of a front end of the main portion 11 are recessed inward towards the inside of the main portion 11 to form two first insertion slots 113. A rear end of the main portion 11 is recessed inward towards the inside of the main portion 11 to form a second insertion slot 114.

The front cover 12 is mounted to a front end of the main portion 11. The front cover 12 opens the insertion hole 14 penetrating through a front surface of the front cover 12 and extending in the main portion 11. The front cover 12 opens a second insertion hole 121 longitudinally penetrating through a middle of the front cover 12. The second insertion hole 121 is corresponding to and communicated with the first insertion hole 111. The first insertion hole 111 cooperates with the second insertion hole 121 to form the insertion hole 14. A top and a bottom of the rear end of the main portion 11 protrude outward away from the inside of the insulating housing 10 to form a plurality of buckling portions 112. The bottom of the rear end of the main portion 11 opens the opening 15 extending upward to the insertion hole 14. The opening 15 is communicated with the insertion hole 14. One side of the bottom of the rear end of the main portion 11 is recessed inward towards the inside of the main portion 11 to form the notch 16 located at one side of the opening 15 and communicated with the opening 15. The notch 16 is located in front of the second insertion slot 114.

Referring to FIG. 4, the rear cover 13 is fastened to the rear end of the main portion 11. A rear surface of the rear cover 13 extends an extending portion 131. The extending portion 131 has two opposite surfaces. The rear cover 13 has a base portion 130, and the extending portion 131 protruded rearward from a rear surface of the base portion 130. Several portions of a top surface and a bottom surface of the extending portion 131 are recessed inward to form a plurality of locating grooves 132 longitudinally penetrating through the base portion 130. An upper portion and a lower portion of a front surface of the base portion 130 protrude frontward to form two fastening boards 133. The two fastening boards 133 open a plurality of buckling holes 134. The plurality of the buckling portions 112 are buckled in the plurality of the buckling holes 134 to prevent the rear cover 13 from falling off.

Referring to FIG. 2 to FIG. 6, the plurality of conductive terminals 20 are fastened to the insulating housing 10. The plurality of conductive terminals 20 are fastened to the main portion 11. The plurality of the conductive terminals 20 include a clamping terminal 21, a right channel terminal 22, a ground terminal 23 and a microphone terminal 24. Each of the plurality of the conductive terminals 20 has a fastening portion 25, a contact portion 26 connected with one end of the fastening portion 25, and a soldering portion 27 connected with the other end of the fastening portion 25. The contact portion 26 of each of the plurality of the conductive terminals 20 elastically projects into the insertion hole 14, and the soldering portion 27 of each of the plurality of the conductive terminals 20 is located on a surface of the rear cover 13. The fastening portions 25 of the plurality of the conductive terminals 20 are fastened to the insulating housing 10. The contact portions 26 of the plurality of the conductive terminals 20 elastically project into the insertion hole 14 and are capable of abutting against corresponding docking positions 205 of the audio plug connector 200. The contact portions 26 of the plurality of the conductive terminals 20 are substantially located in front of the opening 15. The contact portions 26 of the right channel terminal 22, the ground terminal 23 and the microphone terminal 24 are located in front of the opening 15. The contact portions 26 of the plurality of the conductive terminals 20 are positioned longitudinally along the insulating housing 10 and in sequence. The contact portion 26 of the clamping terminal 21, the contact portion 26 of the right channel terminal 22, the contact portion 26 of the ground terminal 23 and the contact portion 26 of the microphone terminal 24 are arranged in a rear-to-front direction. Tail ends of the soldering portions 27 of the plurality of the conductive terminals 20 are exposed out of the insulating housing 10. The soldering portions 27 of the plurality of the conductive terminals 20 are fastened in several of the plurality of the locating grooves 132 and the tail ends of the soldering portions 27 of the plurality of the conductive terminals 20 are exposed to the top surface and the bottom surface of the extending portion 131 correspondingly. The tail ends of the soldering portions 27 of the ground terminal 23 and the microphone terminal 24 are exposed to the top surface of the extending portion 131. The tail end of the soldering portion 27 of the right channel terminal 22 is exposed to the bottom surface of the extending portion 131.

Referring to FIG. 2 to FIG. 6, the clamping terminal 21 is a left channel terminal. The clamping terminal 21 has a base plate 210, two side plates 211 bent downward from two opposite sides of the base plate 210, two clamping arms 212 protruded frontward and then arched towards each other from front edges of the two side plates 211, and a soldering plate 213 bent towards one of the two clamping arms 212 and then extended rearward from a bottom edge of the other clamping arm 212. The base plate 210 is the fastening portion 25. Each of the two clamping arms 212 is the contact portion 26, so the clamping terminal 21 has two contact portions 26. The soldering plate 213 is the soldering portion 27. The base plate 210 of the clamping terminal 21 is fastened in the insulating housing 10. The two clamping arms 212 project into the insertion hole 14 from two sides of the insertion hole 14 and are capable of clamping a rear end of the audio plug connector 200 which is defined as a docking end 206 of the audio plug connector 200. The soldering plate 213 is exposed out of the insulating housing 10. A tail end of the soldering plate 213 of the clamping terminal 21 is fastened in one of the several of the plurality of the locating grooves 132 and is exposed to the bottom surface of the extending portion 131.

Referring to FIG. 2 to FIG. 6 again, the switch terminal assembly 30 is mounted to a bottom of the insulating housing 10. The switch terminal assembly 30 includes a first switch terminal 31 and a second switch terminal 32 which abut against or break away from each other. The first switch terminal 31 is fastened to the bottom of the insulating housing 10. The first switch terminal 31 has a first fixing portion 311, and an elastic arm 312 connected with the first fixing portion 311. Specifically, the first fixing portion 311 has a first base board 313, and two first insertion feet 314 extended upward from two opposite sides of the first base board 313. The elastic arm 312 is extended rearward and then slantwise extended upward and rearward from a middle of a rear edge of the first base board 313. One side of the rear edge of the first base board 313 extends rearward, and then is bent upward towards the bottom of the insulating housing 10 to form a first locating portion 317. A tail end of the first locating portion 317 extends rearward, then slantwise extends rearward and sideward away from the elastic arm 312 and further extends rearward to form a first soldering foot 315. A tail end of the elastic arm 312 is connected with a first touch portion 316 extending sideward away from the first locating portion 317.

The first fixing portion 311 is fastened to the bottom of the insulating housing 10. The elastic arm 312 projects into the insertion hole 14. The first base board 313 is fastened to the bottom of the insulating housing 10. The two first insertion feet 314 are inserted into the two first insertion slots 113 of the insulating housing 10, respectively. The first locating portion 317 is disposed to the bottom of the insulating housing 10. The tail end of the first locating portion 317 projects beyond the rear end of the main portion 11. A tail end of the first soldering foot 315 is exposed out of the insulating housing 10. The first soldering foot 315 is located on the surface of the rear cover 13. Specifically, the tail end of the elastic arm 312 is located under the opening 15. The first touch portion 316 is extended from the elastic arm 312 and elastically abuts against a wall of the notch 16. A tail end of the first touch portion 316 elastically abuts against a top wall of the notch 16. A connecting portion 318 connected between the tail end of the elastic arm 312 and the first touch portion 316 is fastened with an insulating block 33. The insulating block 33 is inserted into the insertion hole 14 from the opening 15, namely the insulating block 33 is substantially located behind the contact portions 26 of the plurality of conductive terminals 20. The insulating block 33 has an inclined surface 331 capable of docking with the audio plug connector 200. The inclined surface 331 is inclined rearward and upward.

The second switch terminal 32 is fastened to the insulating housing 10. The second switch terminal 32 has a second fixing portion 321, a second touch portion 323 extended frontward from a front edge of the second fixing portion 321, and a second soldering foot 322 extended upward and then extended rearward from one side of a tail end of the second fixing portion 321. One side of the second fixing portion 321 away from the second soldering foot 322 is bent upward to form a second insertion foot 324. A middle of the second touch portion 323 is arched upward to form a contact point 325. The second fixing portion 321 is fastened to the bottom of the insulating housing 10. The second soldering foot 322 projects beyond the rear end of the main portion 11 of the insulating housing 10. The second soldering foot 322 is located on the surface of the rear cover 13. The second touch portion 323 and the contact point 325 are corresponding to the notch 16. The second touch portion 323 faces the first touch portion 316. The second touch portion 323 and the contact point 325 are located under and spaced from the first touch portion 316. The second insertion foot 324 is inserted into the second insertion slot 114. The second soldering foot 322 is exposed out of the insulating housing 10. The first soldering foot 315 and the second soldering foot 322 are fastened to two of the plurality of locating grooves 132 and are exposed to the bottom surface of the extending portion 131. The first soldering foot 315, the second soldering foot 322 and at least one of the soldering portions 27 of the plurality of conductive terminals 20 are located on one of the surfaces of the extending portion 131, the other soldering portions 27 are located on the other surface of the extending portion 131.

Referring to FIG. 1 to FIG. 5, the shell 40 is of a hollow cylinder shape. The shell 40 surrounds a peripheral surface of the insulating housing 10 for protecting the insulating housing 10, the conductive terminals 20 and the switch terminal assembly 30. A rear surface and the front surface of the insulating housing 10 are exposed outside. The first soldering foot 315 is extended beyond the shell 40 from a rear portion of the insulating housing 10. The second soldering foot 322 is extended beyond the shell 40 from the rear portion of the insulating housing 10. The shell 40 has a hollow barrel portion 41, and a sealing board 42 sealing a rear end of the barrel portion 41. The sealing board 42 opens a through-hole 43. The extending portion 131 projects beyond a rear surface of the sealing board 42 through the through-hole 43.

The soldering portions 27 of the plurality of the conductive terminals 20 are extended beyond the shell 40 from the rear surface of the insulating housing 10. The soldering portions 27 of the right channel terminal 22, the ground terminal 23 and the microphone terminal 24, the first soldering foot 315 of the first switch terminal 31, and the second soldering foot 322 of the second switch terminal 32 are distributed in the plurality of locating grooves 132 of the top surface and the bottom surface of the extending portion 131 for facilitating soldering the plurality of conductive terminals 20 and effectively preventing short circuits being caused among the plurality of conductive terminals 20. In this case, the soldering portions 27 of the ground terminal 23 and the microphone terminal 24 are wider than the soldering portions 27 of the right channel terminal 22, the first soldering foot 315 of the first switch terminal 31, and the second soldering foot 322 of the second switch terminal 32.

Figure 6:
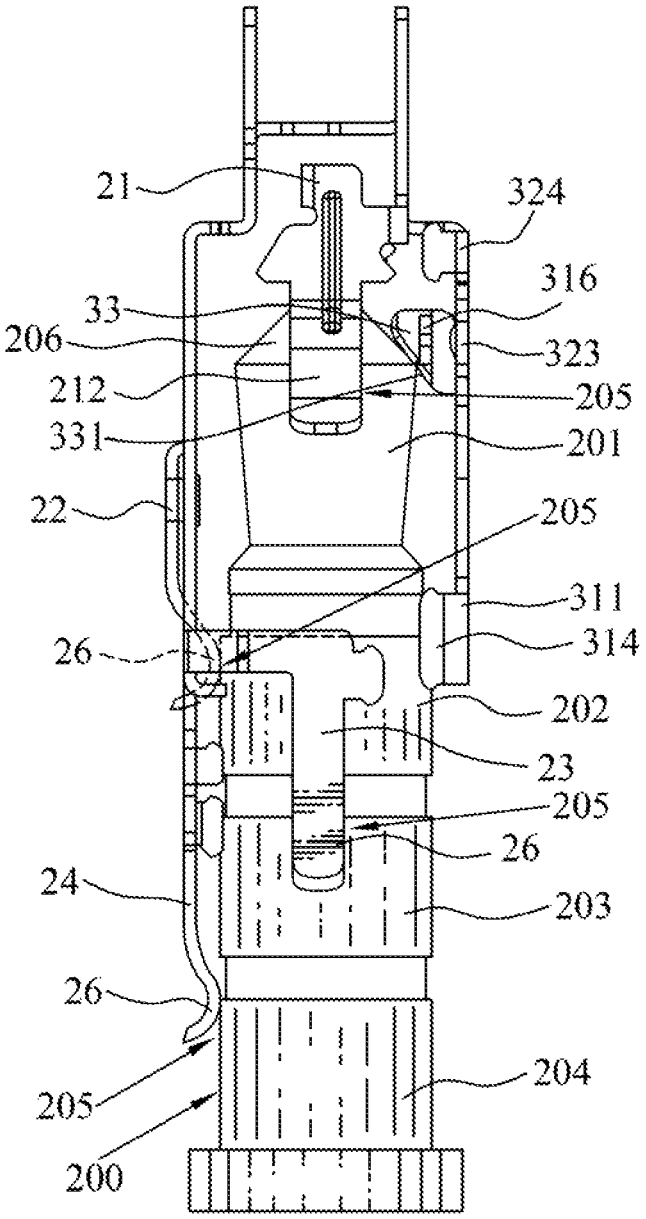
FIG. 6 is a diagrammatic drawing of the audio jack connector of FIG. 1, wherein when an audio plug connector is inserted into the audio jack connector, an electrical conduction is without being made between the audio plug connector and the audio jack connector of FIG. 1.

Referring to FIG. 4 and FIG. 6, the audio plug connector 200 includes a first function ring 201, a second function ring 202, a third function ring 203 and a fourth function ring 204 arranged in the rear-to-front direction. The first function ring 201, the second function ring 202, the third function ring 203 and the fourth function ring 204 abut against the contact portions 26 of the plurality of conductive terminals 20 when the audio plug connector 200 is inserted into the audio jack connector 100. Specifically, after the audio plug connector 200 is inserted into the audio jack connector 100, the two clamping arms 212 of the clamping terminal 21 clamp the first function ring 201. The contact portion 26 of the clamping terminal 21 abuts against the first function ring 201. The contact portion 26 of the right channel terminal 22 abuts against the second function ring 202. The contact portion 26 of the ground terminal 23 abuts against the third function ring 203. The contact portion 26 of the microphone terminal 24 abuts against the fourth function ring 204.

Referring to FIG. 4 and FIG. 6 again, the audio plug connector 200 is inserted into the audio jack connector 100 from the insertion hole 14. When the audio plug connector 200 is inserted into the audio jack connector 100 from the insertion hole 14 until the docking end 206 of the audio plug connector 200 abuts against the inclined surface 331 of the insulating block 33, the two clamping arms 212, namely the two contact portions 26 of the clamping terminal 21, and the contact portions 26 of the right channel terminal 22, the ground terminal 23 and the microphone terminal 24 abut against the corresponding docking positions 205 of the audio plug connector 200, at the moment, the first touch portion 316 and the second touch portion 323 keep a breaking status. The audio plug connector 200 is continued being inserted rearward, the docking end 206 of the audio plug connector 200 pushes the insulating block 33 to move downward along the inclined surface 331 and drives the first touch portion 316 of the first switch terminal 31 to move downward. After the contact portions 26 of the plurality of the conductive terminals 20 contact the corresponding docking positions 205 of the audio plug connector 200 and the audio plug connector 200 is inserted into the audio jack connector 100 in a docking position, the audio plug connector 200 pushes against the insulating block 33 to move downward to make the first touch portion 316 of the first switch terminal 31 abut against the second touch portion 323 of the second switch terminal 32, so an electrical conduction is made between the audio jack connector 100 and the audio plug connector 200.

As described above, after the contact portions 26 of the plurality of the conductive terminals 20 contact the corresponding docking positions 205 of the audio plug connector 200, the audio plug connector 200 pushes against the insulating block 33 to move downward to make the first touch portion 316 of the first switch terminal 31 abut against the second touch portion 323 of the second switch terminal 32, so an electrical conduction is made between the audio jack connector 100 and the audio plug connector 200. As a result, noises of the earphone or the loudspeaker are without being caused in the process of the audio plug connector 200 being inserted into the audio jack connector 100.

What is claimed is:

1. An audio jack connector adapted for being docked with an audio plug connector, comprising:

an insulating housing, an inside of the insulating housing opening an insertion hole penetrating through a front surface of the insulating housing, the audio plug connector being capable of being inserted into the insertion hole, a rear end of the insulating housing opening an opening communicated between the insertion hole and an outside of the insulating housing;

a plurality of conductive terminals fastened to the insulating housing, each of the plurality of the conductive terminals having a contact portion, the contact portions of the plurality of the conductive terminals elastically projecting into the insertion hole and being capable of abutting against corresponding docking positions of the audio plug connector, the contact portions of the plurality of the conductive terminals being substantially located in front of the opening; and a switch terminal assembly mounted to the insulating housing, the switch terminal assembly including a first switch terminal and a second switch terminal which abut against or break away from each other, the first switch terminal having a first fixing portion fastened to the insulating housing, and an elastic arm connected with the first fixing portion, a tail end of the elastic arm being connected with a first touch portion extending sideward, the tail end of the elastic arm being located under the opening, a connecting portion connected between the tail end of the elastic arm and the first touch portion being fastened with an insulating block, the insulating block being inserted into the insertion hole from the opening, the insulating block having an inclined surface capable of docking with the audio plug connector, the inclined surface being inclined rearward and upward, the second switch terminal being fastened to the insulating housing, the second switch terminal having a second fixing portion, and a second touch portion extended frontward from a front edge of the second fixing portion, the second touch portion being located under and spaced from the first touch portion, wherein the audio plug connector is inserted into the audio jack connector from the insertion hole, after the contact portions of the plurality of the conductive terminals contact the corresponding docking positions of the audio plug connector, the audio plug connector pushes against the insulating block to move downward to make the first touch portion abut against the second touch portion.

2. The audio jack connector as claimed in claim 1, wherein the audio plug connector includes a first function ring, a second function ring, a third function ring and a fourth function ring arranged in a rear-to-front direction, the first function ring, the second function ring, the third function ring and the fourth function ring abut against the contact portions of the plurality of conductive terminals when the audio plug connector is inserted into the audio jack connector.

3. The audio jack connector as claimed in claim 2, wherein the plurality of the conductive terminals include a clamping terminal, a right channel terminal, a ground terminal and a microphone terminal, the contact portion of the clamping terminal, the contact portion of the right channel terminal, the contact portion of the ground terminal and the contact portion of the microphone terminal are arranged in the rear-to-front direction, the contact portion of the clamping terminal abuts against the first function ring, the contact portion of the right channel terminal abuts against the second function ring, the contact portion of the ground terminal abuts against the third function ring, the contact portion of the microphone terminal abuts against the fourth function ring.

4. The audio jack connector as claimed in claim 1, wherein the rear end of the insulating housing opens a notch recessed inward towards the inside of the insulating housing and communicated with the opening, a tail end of the first touch portion elastically abuts against a top wall of the notch.

5. The audio jack connector as claimed in claim 1, wherein the first fixing portion has a first base board, and two first insertion feet extended upward from two opposite sides of the first base board, the insulating housing includes a main portion, two sides of a bottom of a front end of the main portion are recessed inward towards an inside of the main portion to form two first insertion slots, the first base board is fastened to a bottom of the insulating housing, the two first insertion feet are inserted into the two first insertion slots, respectively.

6. The audio jack connector as claimed in claim 5, wherein the elastic arm is extended rearward and then slantwise extended upward and rearward from a middle of a rear edge of the first base board.

7. The audio jack connector as claimed in claim 5, wherein one side of the rear edge of the first base board extends rearward, and then is bent upward towards the bottom of the insulating housing to form a first locating portion, a tail end of the first locating portion extends rearward, then slantwise extends rearward and sideward away from the elastic arm and further extends rearward to form a first soldering foot, the tail end of the elastic arm is connected with the first touch portion extending sideward away from the first locating portion, the first locating portion is disposed to the bottom of the insulating housing, the tail end of the first locating portion projects beyond a rear end of the main portion, a tail end of the first soldering foot is exposed out of the insulating housing.

8. The audio jack connector as claimed in claim 7, wherein the second switch terminal has a second soldering foot extended upward and then extended rearward from one side of a tail end of the second fixing portion, the second fixing portion is fastened to the bottom of the insulating housing, the second soldering foot is exposed out of the insulating housing.

9. The audio jack connector as claimed in claim 8, wherein the insulating housing includes a rear cover fastened to the rear end of the main portion, the rear cover has a base portion, and an extending portion protruded rearward from a rear surface of the base portion, several portions of a top surface and a bottom surface of the extending portion are recessed inward to form a plurality of locating grooves longitudinally penetrating through the base portion, the first soldering foot and the second soldering foot are fastened to two of the plurality of locating grooves and are exposed to the bottom surface of the extending portion.

10. The audio jack connector as claimed in claim 8, wherein one side of the second fixing portion away from the second soldering foot is bent upward to form a second insertion foot, the rear end of the main portion is recessed inward towards the inside of the main portion to form a second insertion slot, the second insertion foot is inserted into the second insertion slot.

11. The audio jack connector as claimed in claim 1, wherein the plurality of the conductive terminals include a clamping terminal which has a base plate fastened in the insulating housing, two side plates bent downward from two opposite sides of the base plate, two clamping arms protruded frontward and then arched towards each other from front edges of the two side plates, and a soldering plate bent towards one of the two clamping arms and then extended rearward from a bottom edge of the other clamping arm, the two clamping arms project into the insertion hole from two sides of the insertion hole and are capable of clamping a rear end of the audio plug connector, the soldering plate is exposed out of the insulating housing.

12. The audio jack connector as claimed in claim 11, wherein each of the plurality of the conductive terminals has a fastening portion, the contact portion connected with one end of the fastening portion, and a soldering portion connected with the other end of the fastening portion, the base plate is the fastening portion, each of the two clamping arms is the contact portion, the soldering plate is the soldering portion, the fastening portions of the plurality of the conductive terminals are fastened to the insulating housing, tail ends of the soldering portions of the plurality of the conductive terminals are exposed out of the insulating housing.

13. The audio jack connector as claimed in claim 12, wherein the insulating housing includes a main portion, and a rear cover fastened to a rear end of the main portion, the rear cover has a base portion, and an extending portion protruded rearward from a rear surface of the base portion, several portions of a top surface and a bottom surface of the extending portion are recessed inward to form a plurality of locating grooves longitudinally penetrating through the base portion, the soldering portions of the plurality of the conductive terminals are fastened in several of the plurality of the locating grooves and the tail ends of the soldering portions of the plurality of the conductive terminals are exposed to the top surface and the bottom surface of the extending portion correspondingly.

14. The audio jack connector as claimed in claim 13, wherein the plurality of the conductive terminals include a ground terminal and a microphone terminal, the tail ends of the soldering portions of the ground terminal and the microphone terminal are exposed to the top surface of the extending portion.

15. The audio jack connector as claimed in claim 13, wherein the plurality of the conductive terminals include a right channel terminal, the tail end of the soldering portion of the right channel terminal is exposed to the bottom surface of the extending portion, a tail end of the soldering plate is exposed to the bottom surface of the extending portion.

16. The audio jack connector as claimed in claim 13, further comprising a shell surrounding the insulating housing, the shell having a hollow barrel portion, and a sealing board sealing a rear end of the barrel portion, the sealing board opening a through-hole, the extending portion projecting beyond a rear surface of the sealing board through the through-hole.

* * * * *